US008144889B2

(12) United States Patent
Cheng et al.

(10) Patent No.: US 8,144,889 B2
(45) **Date of Patent: *Mar. 27, 2012**

(54) NOISE CONTROL SYSTEM USING SMART MATERIALS

(75) Inventors: Ming-te Cheng, Ann Arbor, MI (US); Takeshi Abe, Garden City, MI (US); Robert G. Rebandt, II, Wayne, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1112 days.

This patent is subject to a terminal disclaimer.

(21) Appl. No.: 11/638,881

(22) Filed: Dec. 14, 2006

(65) Prior Publication Data

US 2008/0142294 A1 Jun. 19, 2008

(51) Int. Cl.
*G10K 11/16* (2006.01)
*H03B 29/00* (2006.01)

(52) U.S. Cl. ..... 381/71.4; 381/71.1; 381/71.3; 381/71.7; 381/86; 181/148; 181/206; 181/293; 181/295; 181/296

(58) Field of Classification Search ..... 381/71.1, 381/71.3, 71.4, 86, 71.7; 181/206, 293, 199, 181/148, 295, 296
See application file for complete search history.

(56) References Cited

U.S. PATENT DOCUMENTS

| | | | | |
|---|---|---|---|---|
| 4,506,380 | A | 3/1985 | Matsui | 381/71 |
| 4,574,915 | A | 3/1986 | Gahlaii | 181/290 |
| 5,094,318 | A | 3/1992 | Maeda | 181/290 |
| 5,131,047 | A | 7/1992 | Hashimoto | 381/71 |
| 5,321,759 | A | 6/1994 | Yuan | 381/71 |
| 5,386,372 | A * | 1/1995 | Kobayashi et al. | 700/280 |
| 5,554,831 | A | 9/1996 | Matsukawa | 181/294 |
| 5,817,408 | A | 10/1998 | Orimo | 428/218 |
| 6,102,465 | A | 8/2000 | Nemoto | 296/36.3 |
| 6,305,294 | B1 | 10/2001 | Hashino | 104/91 |
| 6,343,127 | B1 * | 1/2002 | Billoud | 381/71.4 |
| 6,554,101 | B2 | 4/2003 | Watanabe | 181/290 |
| 6,589,643 | B2 * | 7/2003 | Okada | 428/297.4 |
| 6,767,050 | B2 * | 7/2004 | Junker | 296/193.02 |
| 7,017,250 | B2 * | 3/2006 | Gebreselassie | 29/428 |
| 7,070,848 | B2 * | 7/2006 | Campbell | 428/137 |
| 2004/0130081 | A1 * | 7/2004 | Hein et al. | 267/140.14 |
| 2004/0240678 | A1 * | 12/2004 | Nakamura | 381/71.11 |
| 2005/0150720 | A1 * | 7/2005 | Tudor | 181/286 |

* cited by examiner

*Primary Examiner* — Vivian Chin
*Assistant Examiner* — Paul Kim
(74) *Attorney, Agent, or Firm* — Gregory P. Brown; MacMillian, Sobanski & Todd, LLC

(57) ABSTRACT

A noise control system operable within a box-like structure provided by the dual bulkhead plenum of the vehicle dashboard positioned within the transfer path along which the noise is being transmitted from the source of the generated noise to the receiver of the noise in the passenger compartment of an automobile. The plenum is divided into discrete chambers into each of which is provided smart materials affixed to the walls of the plenum to be operable for selectively changing a property characteristic of the chambers to vary the acoustic resonance of the plenum and change the effectiveness of controlling the transmission of noise energy therethrough. A controller is coupled to the smart materials to change said property characteristic of the smart material in response to noise cancellation requirements.

17 Claims, 4 Drawing Sheets

Fig. 1
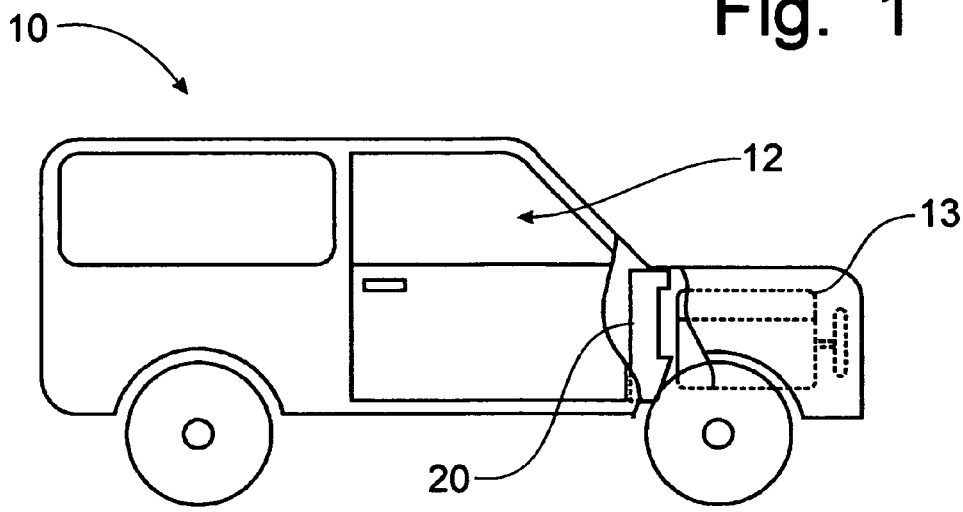
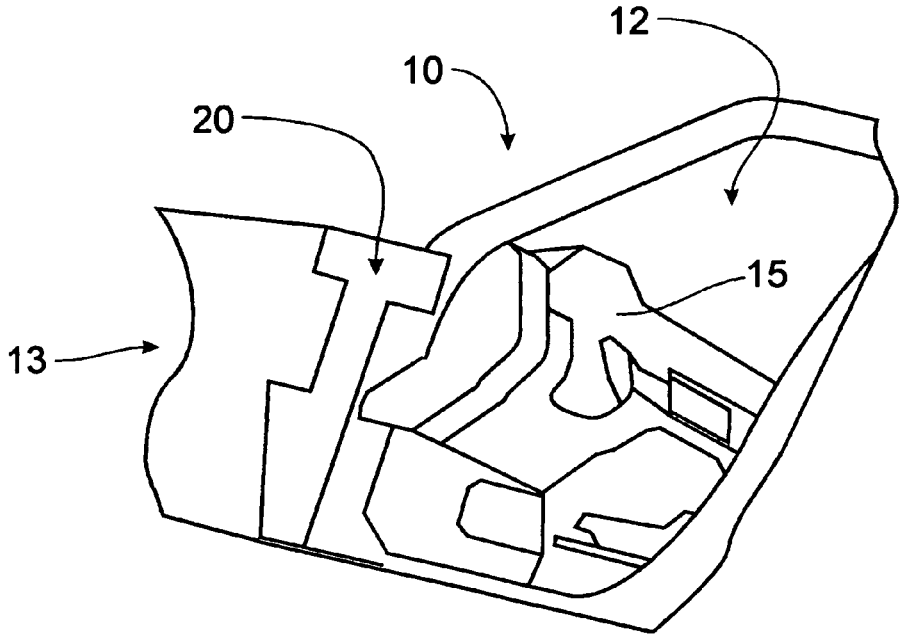
Fig. 2

Fig. 3
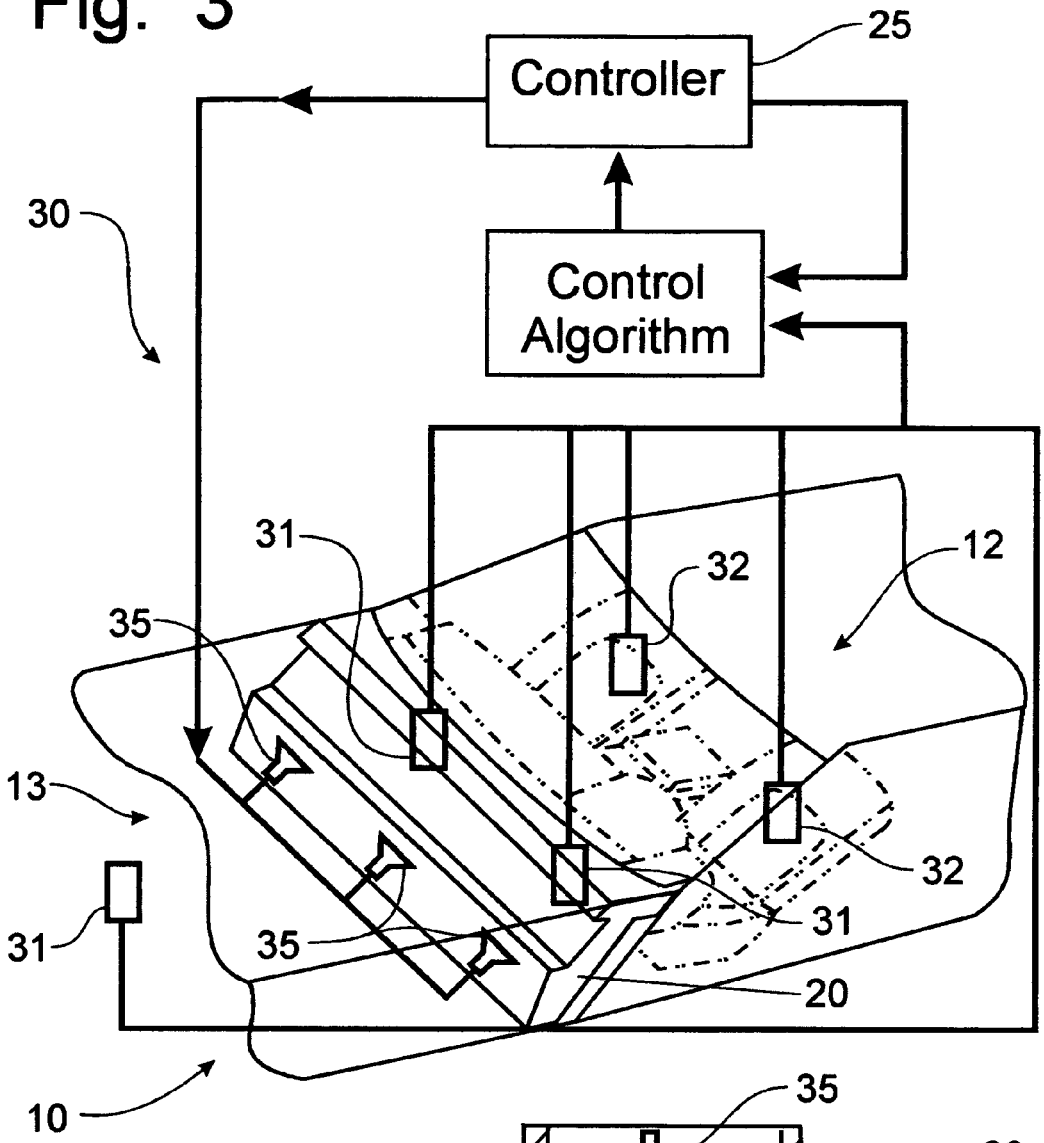
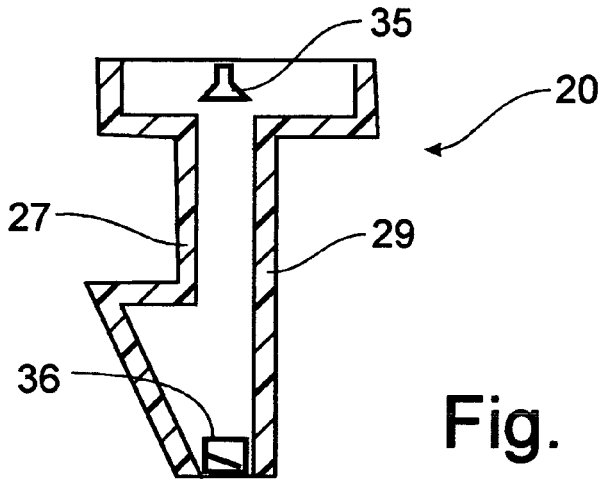
Fig. 4

Fig. 5
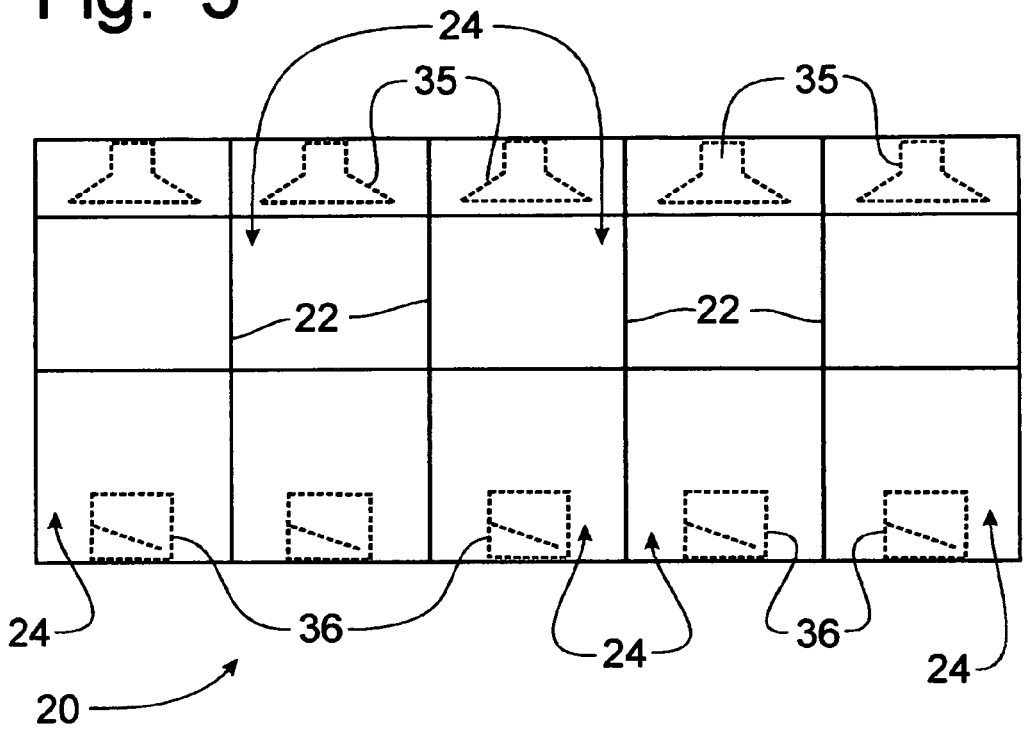
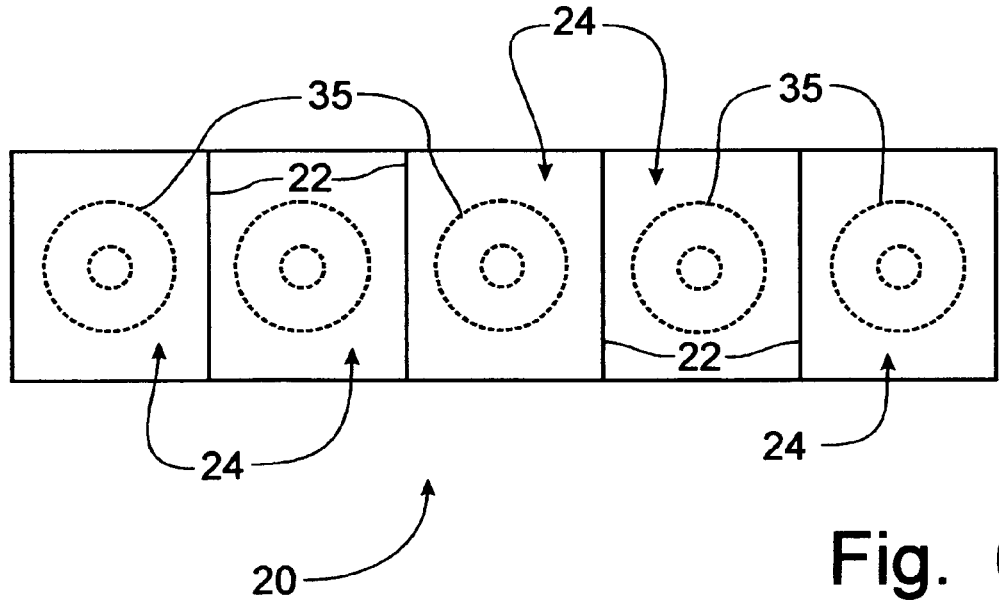
Fig. 6

Fig. 7
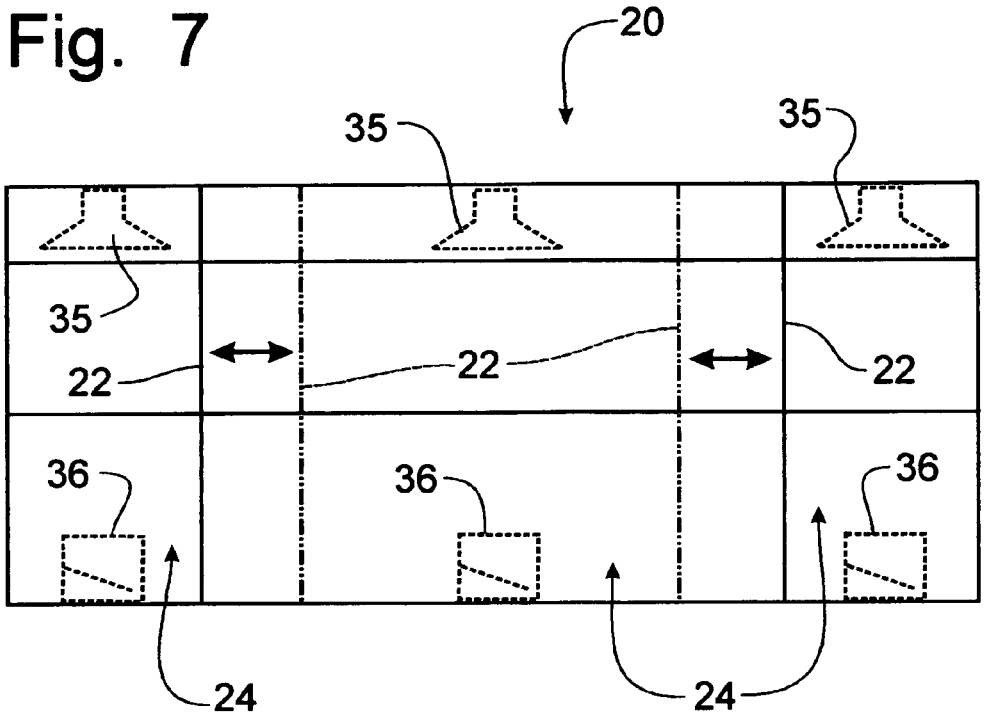
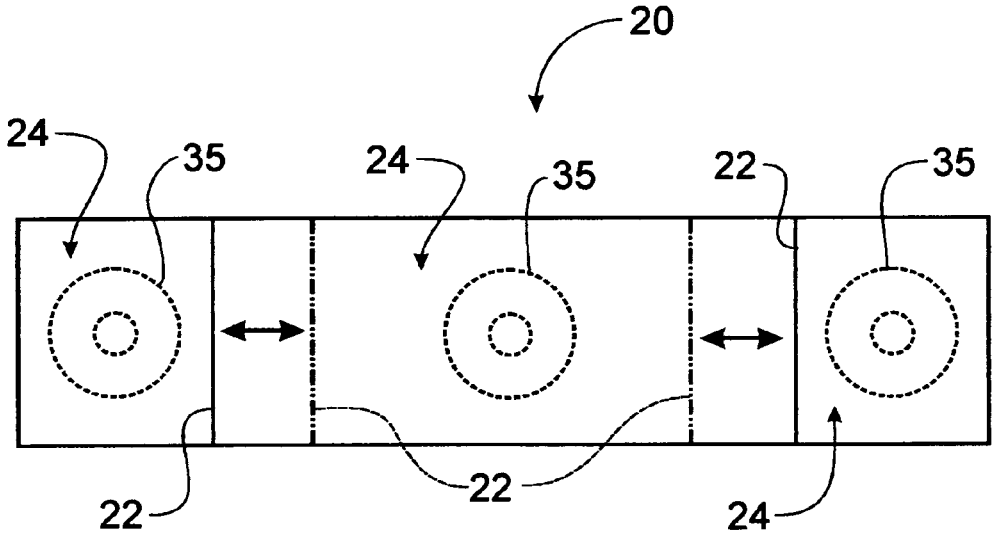
Fig. 8

NOISE CONTROL SYSTEM USING SMART MATERIALS

FIELD OF THE INVENTION

This invention relates generally to the control the noise generated by an automotive vehicle and, more particularly, to the reduction of noise in the passenger compartment of an automotive vehicle by controlling the transmission of the noise along the acoustic transfer path from the source of the noise to the receiver of the noise with a box-like structure having smart materials affixed thereto for modifying the acoustic resonance of the box-like structure.

BACKGROUND OF THE INVENTION

The operation of the powertrain in an automobile is one of the major contributors of noise received within the passenger compartment of the automobile. With new powertrain technology, such as electronic valve actuation and variable displacement engine, new methods are needed to control the interior noise. In order to improve customer perceived interior noise quality, passenger compartment active noise control has been a popular strategy. Such methods of noise control are discussed below relative to prior art documents. Generally, these methods are expensive and only control the receiving end of the problem such as the passenger driver's ear positions. Other methods of controlling noise are directed to the source, such as an active control of the induction or exhaust systems, have been developed. However, active control capability is limited and is very complex and expensive. Therefore, active noise control systems have not proven to be popular even though the methodology and technical capability have existed for many years.

An example of active passenger cabin sound suppression technology can be found in U.S. Pat. No. 4,506,380 granted to Shinichi Matsui on Mar. 19, 1985, in which speakers disposed in the dash panel of the vehicle are individually energized to selectively cancel the resonance occurred with respect to engine vibration. Similarly, an active vibration/noise control system in taught in U.S. Pat. No. 5,386,372, issued on Jan. 31, 1995, to Toshiski Kobayashi, et al, wherein speakers are arranged in suitable locations in the dashboard of the passenger compartment to control the noise from the engine. Self-expanding engine mounts have actuators formed of piezoelectric elements or magnetostrictive elements to prevent the vibrations from being transmitted from the engine.

Passive sound-absorbing materials are utilized throughout an automotive vehicle to reduce noise transmission. An example is found in U.S. Pat. No. 7,017,250, issued to Girma Gebreselassie, et al, on Mar. 28, 2006, wherein a dash insulator system has a substrate made from foam that is used to absorb the sound directed to a dash insulator. In U.S. Pat. No. 4,574,915, granted to Heinemann Gahlaii, et al on Mar. 11, 1986, sound-insulating cladding, formed from viscoelastic foam material is secured on the face of the front bulkhead to provide a sound-insulated area. Sound absorbing materials are used in the dashboard area of the vehicle to provide a passive noise cancellation system preventing the noise generated in the engine compartment from being transmitted to the passenger compartment, as is suggested in U.S. Pat. No. 5,094,318, granted to Takashi Maeda, et al on Mar. 10, 1992; in U.S. Pat. No. 5,554,831, granted to Hiroshi Matsukawa, et al on Sep. 10, 1996; in U.S. Pat. No. 5,817,408, granted to Motohiro Orimo, et al on Oct. 6, 1998; in U.S. Pat. No. 6,102,465, granted to Kouichi Nemoto on Aug. 15, 2000; and in U.S. Pat. No. 6,554,101 granted to Kyoichi Watanabe on Apr. 29, 2003.

An isolator system, comprised of cast foam, is affixed to horizontal and vertical portions of the vehicle dash panel to reduce the transmission of unwanted noise and vibration from the engine compartment is taught in U.S. Pat. No. 6,767,050 granted to Christian Junker on Jul. 27, 2004, and assigned to Ford Global Technologies, LLC, and in U.S. Pat. No. 7,070,848 granted to Michael Campbell on Jul. 4, 2006. An automotive dash insulator system, used to reduce noise transmission from the engine to the interior of the vehicle, is formed with a sound-absorbing layer comprised of viscoelastic foam as depicted in U. S. Patent Application Publication No. 2005/0150720, of Jay Tudor, et al, published on Jul. 14, 2005.

A noise cancellation system using a piezo-electric control scheme can be found in U.S. Pat. No. 6,589,643, granted on Jul. 8, 2003, to Jun Okada, et al, in which sound absorbing material, such as piezo-electric material, is used to insulate a dashboard in a vehicle to absorb and prevent the entry of low-frequency noise from the engine into the passenger compartment. In U. S. Patent Application Publication No. 2004/0130081 of David Hein, published on Jul. 8, 2004, a piezoelectric actuator and sensor assemblies are introduced between various structures contained within the instrument panel to minimize vibration within the instrument panel structure.

Adaptive filters have also been used to control noise generated from a noise source, such as the engine in an automobile, as taught in U.S. Pat. No. 5,131,047, issued to Hiroyuki Hashimoto, et al on Jul. 14, 1992, where a speaker is utilized to reproduce engine noise that cancels the generated engine noise. In U.S. Pat. No. 5,321,759, granted to Yi Yuan on Jun. 14, 1994, adaptive filters having transversal filters are utilized in an active noise control system to cancel engine generated vibrational noise. A directional microphone is integrated into the dashboard to achieve a directional effect for controlling automotive noise is taught in U.S. Pat. No. 6,305,732, granted on Oct. 23, 2001, to Hans-Wilheim Ruhl. In U.S. Pat. No. 6,324,294, issued on Nov. 27, 2001 to Henry Azima, et al, loud speaker panels are attached to or installed in the dashboard of an automobile. U. S. Patent Application Publication No. 2004/0240678 of Yoshio Nakamura, et al, published Dec. 2, 2004, discloses an active noise control system that uses a speaker to cancel problematic noise generated by the engine.

It would be desirable to provide a system for reducing engine noise that is directed to the transfer path, rather than the source or the receiver of the noise. It would also be desirable to provide a system that utilizes a box-like structure imposed transversely across the transfer path so that the natural acoustic resonance of the structure can be utilized to aid in the control of the transmitted noise. It would be further desirable to provide a box-like structure in which the acoustic resonance can be changed to control the transmission of noise energy through the box-like structure.

SUMMARY OF THE INVENTION

It is an object of this invention to overcome the aforementioned disadvantages of the known prior art by providing a noise cancellation system that is directed to the transfer path of the noise transmission.

It is another object of this invention to provide an adaptive system for controlling noise generated at the engine that is deployed within the dual bulkhead plenum of an automotive dashboard.

It is a feature of this invention that the dual bulkhead plenum in the vehicle dashboard is located along the transfer path along which engine noise is transmitted into the passenger compartment.

It is an advantage of this invention that utilization of sound cancellation techniques within the dual bulkhead plenum is directed to the transmission of the noise, as opposed to being directed to the source or receiver of the noise.

It is another feature of this invention that the constrained volume of the dual bulkhead plenum helps to provide a more efficient noise control system.

It is still another advantage of this invention that the deployment of simple hardware or software systems can provide a low cost and high capability active noise control within the dual bulkhead plenum of the vehicle dashboard.

It is still another object of this invention to reduce the transmission of engine noise into the passenger compartment of an automotive vehicle by interrupting the transfer path of the noise transmission.

It is still another feature of this invention to provide an adaptive noise control system within the dual bulkhead plenum of an automotive dashboard.

It is yet another feature of this invention to utilize speakers within the dual bulkhead plenum to cancel engine noise being transmitted through the plenum.

It is yet another advantage of this invention that the plenum can be damped with sound absorbing acoustic materials attached to the surface of the sheet metal forming the bulkhead.

It is a further feature of this invention that smart materials can be affixed to the walls of the box-like structure through which the noise energy is transferred to the passenger compartment of the vehicle.

It is a further advantage of this invention that the smart materials can provide a modification of the box-like structure to allow the noise control system to adapt to changes in operational environmental conditions.

It is still a further feature of this invention that the smart materials can be selectively modified to change the acoustic resonance of the box-like structure.

It is still a further advantage of this invention that the smart materials be modified to change the damping of the sheet metal walls for control and cancellation of vibrational energy being transmitted through the box-like structure.

It is yet a further feature of this invention that the utilization of smart materials applied to the walls of the box-like structure enhances the performance of an adaptive noise control system.

It is yet a further advantage of this invention that a controller in the noise control system can affect modification of the smart materials to modify the operation of the noise control system in preventing the transfer of noise energy into the passenger compartment.

It is a further advantage of this invention that the noise control system is placed in a less harsh environment than being utilized at the source of the noise.

It is still a further advantage of this invention that the noise control system can be adapted to any automotive vehicle utilizing a dual bulkhead instrument panel design.

It is yet another object of this invention to divide the box-like structure imposed across the transfer path of the noise being transmitted into chambers within each of which is located an apparatus for creating a counteracting noise generation device.

It is a further feature of this invention that the individual chambers has a natural acoustic resonance that can be utilized to amplify the counteracting noise that is generated therein to control the transmission of the noise along the transfer path.

It is still another advantage of this invention that the natural acoustic resonance of the individual chambers formed in the dual bulkhead plenum will enhance the operation of the noise control system.

It is still a further feature of this invention that the internal walls within the dual bulkhead plenum can be positioned to provide variable geometry chambers.

It is yet another advantage of this invention that the different geometries of the internal chambers provide correspondingly different acoustic resonances that can be tuned to provide an optimized packaging and noise control strategy.

It is yet a further feature of this invention that the respective chambers formed within the dual bulkhead plenum can be tuned for different acoustic modes.

It is a further advantage of this invention the noise permitted to transfer to the driver's side of the passenger compartment can be different than the noise permitted to transfer to the passenger side of the passenger compartment.

It is still another feature of this invention that smart materials can be applied to the walls of each respective chamber to permit the acoustic resonance of each respective chamber to be selectively modified independently.

It is still another advantage of this invention that the use of smart materials in each respective chamber can provide an independent selectively modifiable damping function in each respective chamber.

It is yet another object of this invention to provide a noise control system, utilizing a multi-chamber plenum design placed along the transmission transfer path of the noise, which is durable in construction, inexpensive of manufacture, carefree of maintenance, facile in assemblage, and simple and effective in use.

These and other objects, features and advantages are accomplished according to the instant invention by providing a noise control system operable within a box-like structure provided by the dual bulkhead plenum of the vehicle dashboard positioned within the transfer path along which the noise is being transmitted from the source of the generated noise to the receiver of the noise in the passenger compartment of an automobile. The plenum is divided into discrete chambers into each of which is provided smart materials affixed to the walls of the plenum to be operable for selectively changing a property characteristic of the chambers to vary the acoustic resonance of the plenum and change the effectiveness of controlling the transmission of noise energy therethrough. A controller is coupled to the smart materials to change said property characteristic of the smart material in response to noise cancellation requirements.

BRIEF DESCRIPTION OF THE DRAWINGS

The advantages of this invention will become apparent upon consideration of the following detailed disclosure of the invention, especially when taken in conjunction with the accompanying drawings wherein:

FIG. 1 is a partial schematic side elevational view of an automotive vehicle having a noise control system incorporating the principles of the instant invention;

FIG. 2 is a partial schematic perspective view of an automotive vehicle having a dual bulkhead plenum into which the noise control system is deployed to control the transmission of engine noise into the passenger compartment;

FIG. 3 is a diagrammatic view of the active noise control system utilizing speakers mounted in the dual bulkhead plenum of the automotive instrumentation panel;

FIG. 4 is a schematic side elevational view of the dual bulkhead plenum to depict the application of acoustic material within the plenum;

FIG. 5 is a schematic front elevational view of the plenum divided into discrete chambers into each of which is placed a counter noise generating apparatus;

FIG. 6 is a schematic top plan view of the plenum depicted in FIG. 5;

FIG. 7 is a schematic front elevational view of the plenum divided into chambers having a variably positionable internal wall to define internal chambers with tunable geometry, the movement of the internal walls being shown in phantom; and FIG. 8 is a schematic top plan view of the plenum depicted in FIG. 7.

DETAILED DESCRIPTION OF THE PREFERRED EMBODIMENT

Referring to FIGS. 1-4, an automotive vehicle incorporating the principles of the instant invention can best be seen. The control of undesirable noise intruding into the passenger compartment of an automobile has been the subject of recent development. Some noise control systems take the approach of countering the sound waves after they enter the passenger compartment, such as by introducing opposing sound waves via speakers appropriately arranged within the passenger compartment. Other noise control systems take the approach of countering the sound waves at the point of generation, such as by introducing opposing sound waves by speakers located appropriately within and/or around the engine, such as a speaker positioned at the air intake for the engine. The instant invention takes a unique approach to the control of noise by countering the sound waves along the transfer path of the noise, as opposed to at the receiver or at the generator.

To control acoustic transfer functions between the source, e.g. the engine 13, and the receiver, e.g. the passenger cabin 12 of the automobile 10, a box-like structure is placed along the transfer path between the generator and receiver. In some automotive vehicles 10, the instrument panel 15 is provided with a dual bulkhead plenum 20 located between the engine 13 and the passenger compartment 12. The dual bulkhead plenum 20 provides a suitable box-like structure for controlling the transfer of sound waves or vibrations along the transfer path through the instrument panel 15 in to the passenger compartment 12. Due to the lower level of sound or vibrational energy passing through the plenum 20 and the constrained volume of the plenum 20, very low cost, yet high capability, active noise control system can be utilized within the plenum 20 utilizing relatively simple hardware and software systems.

The noise control system 30 can include sensors 31 within the engine compartment to identify the frequency and amplitude of the sound energy being produced by the engine 13 for transfer to the passenger compartment 12 through the dual bulkhead plenum 20, and sensors 32 within the passenger compartment 12 to identify the frequency and amplitude of the sound energy being transmitted into the passenger compartment 12. These sensors 31 ascertain the acoustic environment of the vehicle 10 and can sense conditions such as temperature, vehicle speed, and engine RPM's. Thus, these sensors 31 can be utilized in an open loop control system that employs a control algorithm that can result in the production of a counteracting sound wave introduced by speakers 35 within the plenum 20. The controller 25 employs a mathematical model of the vehicle's acoustic response to these environmental conditions through the control algorithm and generates the counteracting sound wave in response to the predicted sound energy level.

Accordingly, speakers 35 are placed within the plenum 20 to introduce the countering sound energy to cancel out the sound waves being transmitted along the transfer path through the plenum 20. Vibrational energy can also be countered by opposing counteractive vibrational energy, which can be induced into the plenum 20 by a vibrator 36, schematically depicted in FIG. 4, that generates a vibration in the walls of the plenum that has an opposite amplitude and frequency to the vibrations emanating from the engine 13 or other vehicle component and being transmitted through the plenum 20.

Instead of the traditional feed forward/feedback active noise control, adaptive transversal filters can be applied in the noise control system 30. Adaptive control is a special type of open loop active control in which the controller 25 employs a mathematical model of the vehicle's acoustic response, and possibly of the actuators and sensors. Due to the possible change of the acoustic environment over time, because of changes in temperature and other operating conditions for the vehicle 10, the adaptive controller 25 monitors the response, such as through the sensors 32 to identify the success of the noise control system 30 in canceling the generated noise, and continually or periodically updates the internal model of the system.

Alternatively, or as an optional addition to the speakers 35 and or vibrators 36, the plenum 20 can be lined with acoustic materials 27, 29, as are depicted in FIG. 4. Examples of this passive approach to sound management are acoustic damping materials, such as a damping sheet with a viscoelastic surface to provide a high damping over broad temperatures and frequency ranges. Acoustic absorption materials, such as acoustic foam 29, can provide maximum sound absorption with minimal thickness layers of foam applies to the surface of the sheet metal of the plenum 20 to reduce reverberation. Acoustic barrier materials, such as a heavy vinyl barrier 27 to block airborne sound with foam to reduce impact noise, provide maximum sound attenuation with high transmission loss. Coupling the passive acoustic materials with the active sound control system 30 can provide a highly capable noise control system, as is reflected in FIG. 4.

Referring now to FIGS. 5-8, the plenum 20 can be divided by internal walls 22 into a plurality of discrete chambers 24. Each chamber 24 has mounted therein a noise control system 30, such as a speaker 35 and a vibration generator 36. Each chamber 24 will have a natural acoustic resonance. This acoustic resonance can be utilized to amplify the counteracting noise generated by the noise control system 30. As a result, a low cost and high capability active noise control can be accomplished with simple hardware or software systems. While five chambers 24 are represented in the drawings, the number of chambers 24 provided in the plenum 20 will depend on the geometry of the plenum 20, the specifics of the noise control system 30 that is employed, and the results that are desired, as will be described in greater detail below. The controller 25 can be operable to control each of the speakers 35 and/or shakers 36 within the chambers 24 separately such that each chamber 24 produces a different noise cancellation energy corresponding to the noise energy passing through the chamber 24, as the respective chambers 24 can be subjected to different generated noise energy.

As depicted in FIGS. 7-8, the internal walls 22 can be variably positionable within the plenum 20 by providing multiple sets of hangers (not shown) on which the internal walls 22 can be mounted. As a result, the chambers 24 can have variable geometry and a resultant variable acoustic resonance. Thus, the individual chambers 24 can be sized and tuned to provide different desired results to different parts of the passenger compartment 12. For example, if certain engine generated sounds and/or certain road noise is deemed desirable for the driver of the vehicle 10, which noise would not be desirable for the passenger on the opposing side of the vehicle 10, the corresponding chambers 24 can be configured to provide a desired acoustic mode for the amplification of the noise cancellation energy in a manner to allow certain noise frequencies to pass through the plenum 20 to the driver's side of the passenger compartment 12, while eliminating those frequencies into the passenger side of the passenger compartment 12. Furthermore, the chambers 24 can be configured to optimize the packaging of the speaker 35 and/or shaker 36 output power with respect to the sound cancellation or sound shaping strategy to be employed by the noise cancellation system 30.

The application of smart materials to the walls of the respective chambers 24 will allow each of the chambers 24 to be modified in a selective manner to change the acoustic resonance of the chamber, as well as modify the damping effect of the chamber with respect to vibrational energy being transmitted through the plenum chambers 24 to the passenger compartment 12. The use of smart materials can be in place of, or in addition to, the passive acoustic materials, such as the acoustic absorption materials 29 or the acoustic barrier materials 27, as depicted in FIG. 4. Smart materials is defined as a material having a material property that will change based on the electric current supplied to the material, such that the shape or damping properties can be selectively controlled. Such smart materials include piezoelectric material, magneto-rheological (MR) material, electro-rheological (ER) material, and electro-magnetic film.

Piezoelectric materials have two unique properties which are interrelated. When a piezoelectric material is deformed, it gives off a small but measurable electrical discharge. Alternately, when an electrical current is passed through a piezoelectric material it experiences a significant increase in size (up to a 4% change in volume) which will affect to the acoustic effect of the chambers. Another similar approach is to use electro-rheological (ER) and magneto-rheological (MR) materials. These smart materials can change from a thick fluid (similar to motor oil) to a nearly solid substance within the span of a millisecond when exposed to a magnetic or electric field. The effect can be completely reversed just as quickly when the magnetic or electric field is removed. MR fluids experience a viscosity change when exposed to a magnetic field, while ER fluids experience similar changes in an electric field. The composition of each type of smart fluid varies widely. The most common form of MR fluid consists of tiny iron particles suspended in oil, while ER fluids can be as simple as milk chocolate or cornstarch and oil. MR fluids are being developed for use in car shocks, damping washing machine vibration, prosthetic limbs, exercise equipment, and surface polishing of machine parts. ER fluids have mainly been developed for use in clutches and valves, as well as in engine mounts, designed to reduce noise and vibration in vehicles. Electro-magnetic film changes damping characteristics when electric current is applied to the film.

The application of such smart materials to the surface of the walls of the chambers 24, or to the walls of the dual bulkhead plenum 20 even if not divided into chambers 24, will allow the controller 20 to selectively change the acoustic resonance of each individual chamber 24 independently, as well as change the vibrational damping characteristics of each individual chamber 24. By electrically coupling the smart material to the controller 25, with a separate circuit for each respective chamber 24, the controller 25 can change the acoustic resonance of each respective chamber in response to a change in operational environmental conditions sensed by the environmental sensors 31 or the effectiveness of the noise control system 30 as detected by the response sensors 32.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

For example, this noise control technology can be adapted and expanded for use in other vehicle structures, such as the wheel fender and trunk, wherever a boxlike structure can be realized within the confines of the vehicle structure.

The invention claimed is:

1. An automotive vehicle, comprising:

a chassis defining an engine compartment and a longitudinally spaced passenger compartment;

an engine mounted in said engine compartment and being operable to generate noise energy;

a transverse box-like structure having a constrained volume separate from the passenger compartment that is interposed between said engine compartment and said passenger compartment within the transfer path of the noise energy being transmitted from said engine to said passenger compartment, said box-like structure being divided into chambers by internal longitudinally extending walls;

smart material affixed to the walls of each respective chamber of said box-like structure, said smart material being operable to selectively change a property characteristic thereof; and a noise control system including a controller operatively coupled to said smart material to change said property characteristic to vary the acoustic resonance of each respective chamber of said box-like structure to change the effectiveness of controlling the transmission of noise energy through said box-like structure.

2. The automotive vehicle of claim 1 wherein said noise control system further includes:

counteracting noise generating apparatus located within said box-like structure and being operable to produce counteracting noise energy for the generated noise energy, said controller being operably connected to said counteracting noise generating apparatus to control the operation thereof.

3. The automotive vehicle of claim 2 wherein said noise control system further includes environmental sensors coupled to said controller to provide a signal indicative of operational environmental conditions relating to said generated noise energy, and response sensors positioned within said passenger compartment and coupled to said controller to provide a signal indicative of the generated noise energy reaching said passenger compartment.

4. An automotive vehicle, comprising:

a chassis defining an engine compartment and a longitudinally spaced passenger compartment;

an engine mounted in said engine compartment and being operable to generate noise energy;

a transverse box-like structure interposed between said engine compartment and said passenger compartment within the transfer path of the noise energy being transmitted from said engine to said passenger compartment, said box-like structure being divided into chambers by internal longitudinally extending walls;

smart material affixed to the walls of each respective chamber of said box-like structure, said smart material being operable to selectively change a property characteristic thereof;

a noise control system including a controller operatively coupled to said smart material to change said property characteristic to vary the acoustic resonance of each respective chamber of said box-like structure to change the effectiveness of controlling the transmission of noise energy through said box-like structure;

counteracting noise generating apparatus located within said box-like structure and being operable to produce counteracting noise energy for the generated noise energy, said controller being operably connected to said counteracting noise generating apparatus to control the operation thereof; and environmental sensors coupled to said controller to provide a signal indicative of operational environmental conditions relating to said generated noise energy, and response sensors positioned within said passenger compartment and coupled to said controller to provide a signal indicative of the generated noise energy reaching said passenger compartment;

wherein said counteracting noise generation apparatus is mounted within each respective said chamber such that said controller can operate each respective chamber independently of the other said chambers.

5. The automotive vehicle of claim 4 wherein said smart materials are selected from the group consisting of piezoelectric material, electro-rheological material, magneto-rheological material, and electro-magnetic film.

6. The automotive vehicle of claim 5 wherein said internal walls can be positioned at different transversely spaced locations to provide respective chambers having different geometrical configurations, resulting in correspondingly different natural acoustic resonances.

7. The automotive vehicle of claim 6 wherein the transverse box-like structure is a dual bulkhead plenum connected to an instrument panel located at a forward position in said passenger compartment, said counteracting noise generating apparatus including speakers mounted within each respective chamber and being electrically coupled to said controller.

8. The automotive vehicle of claim 7 wherein said passenger compartment is divided into a driver side and a passenger side, the chambers corresponding to said driver side being operated to allow certain generated noise energy to pass through the chamber into said driver side, while the chambers corresponding to said passenger side are operated to cancel said certain generated noise energy.

9. A noise control system for an automobile having a noise generating apparatus producing generated noise energy and a passenger compartment receiving said generated noise energy, comprising:

a hollow box-like plenum having a constrained volume separate from the passenger compartment that is located along a transfer path extending between said noise generating apparatus and said passenger compartment such that said generated noise energy passes through said plenum before reaching said passenger compartment;

smart material affixed to the walls of said box-like plenum, said smart material being operable to selectively change a property characteristic thereof in response to a stimulus applied thereto, said smart material being operable to change a sound transmission property of said box-like plenum;

a controller operably connected to said smart material to provide said stimulus for selectively changing said sound transmission property; and counteracting noise generating apparatus located within said box-like plenum and being operable to produce counteracting noise energy for the generated noise energy, said controller also being operably connected to said counteracting noise generating apparatus to control the operation thereof.

10. The noise control system of claim 9 wherein said box-like plenum is divided into transversely spaced chambers by internal walls, each said chamber having said smart material affixed to the walls thereof and counteracting noise generating apparatus mounted therein.

11. The noise control system of claim 10 wherein said smart materials are selected from the group consisting of piezoelectric material, electro-rheological material, magneto-rheological material, and electro-magnetic film.

12. The automotive vehicle of claim 11 wherein said internal walls can be positioned at different transversely spaced locations to provide respective chambers having different geometrical configurations, resulting in correspondingly different natural acoustic resonances.

13. The automotive vehicle of claim 12 wherein the transverse box-like plenum is a dual bulkhead plenum connected to an instrument panel located at a forward position in said passenger compartment, said counteracting noise generating apparatus including speakers mounted within each respective chamber and being electrically coupled to said controller.

14. A method of controlling a transmission of noise energy in an automobile having a noise generating apparatus producing generated noise energy and a passenger compartment receiving said generated noise energy, comprising the steps of:

intercepting said generated noise energy along a transfer path extending between said noise generating apparatus and said passenger compartment by a transversely extending plenum having a constrained volume separate from the passenger compartment;

applying smart material to said plenum, said smart material being operable to selectively change a property characteristic thereof in response to a stimulus applied thereto, said smart material being operable to change a sound transmission property of said plenum;

providing a controller operably coupled to said smart material to provide said stimulus for selectively changing said sound transmission property, said controller being operable to selectively change said sound transmission property of said plenum by stimulating said smart material to reduce the transmission of said generated noise energy into said passenger compartment; and generating a counteracting noise energy by counteracting noise generating apparatus located within said plenum, said controller being operably connected to said counteracting noise generating apparatus to control the operation thereof in conjunction with the operation of said smart material.

15. The method of claim 14 further comprising the steps of:

sensing operational environmental conditions with environmental sensors coupled to said controller to provide a signal indicative of said operational environmental conditions relating to said generated noise energy; and sensing the transmission of generated noise energy into said passenger compartment with response sensors positioned within said passenger compartment and coupled to said controller to provide a signal indicative of the generated noise energy reaching said passenger compartment; and said step of providing said stimulus by said controller being in response to the signals provided to said controller from said environmental and response sensors.

16. A method of controlling a transmission of noise energy in an automobile having a noise generating apparatus producing generated noise energy and a passenger compartment receiving said generated noise energy, comprising the steps of:

intercepting said generated noise energy along a transfer path extending between said noise generating apparatus and said passenger compartment by a transversely extending plenum;

dividing said plenum into chambers by placing longitudinally extending internal walls within said plenum;

applying smart material to said plenum, said smart material being operable to selectively change a property characteristic thereof in response to a stimulus applied thereto, said smart material being operable to change a sound transmission property of said plenum;

providing a controller operably coupled to said smart material to provide said stimulus for selectively changing said sound transmission property, said controller being operable to selectively change said sound transmission property of said plenum by stimulating said smart material to reduce the transmission of said generated noise energy into said passenger compartment;

placing a counteracting noise energy generating apparatus within each respective said chamber;

generating a counteracting noise energy by counteracting noise generating apparatus located within said plenum, said controller being operably connected to said counteracting noise generating apparatus to control the operation thereof in conjunction with the operation of said smart material;

wherein said applying step places said smart material in each said chamber; and wherein said step of providing said controller operably coupled to said smart material to provide said stimulus includes placing said smart material in each said chamber in a separate circuit so that each said chamber can be operated independently with respect to both stimulating said smart material and generating said counteracting noise energy.

17. The method of claim 16 wherein said longitudinally extending internal walls can be positioned at different transversely spaced locations within said plenum to provide respective chambers having different geometrical configurations, resulting in correspondingly different natural acoustic resonances, said passenger compartment being divided into a driver side and a passenger side, said smart material and counteracting noise generating apparatus in said chambers corresponding to said driver side being operated to allow certain generated noise energy to pass into said driver side, while said smart material and counteracting noise generating apparatus in chambers corresponding to said passenger side are operated to cancel said certain generated noise energy.

* * * * *